US006286923B1

(12) United States Patent
Sugahara

(10) Patent No.: US 6,286,923 B1
(45) Date of Patent: Sep. 11, 2001

(54) INK JET PRINTER THAT CHANGES WAVEFORM OF DRIVE PULSE TO INCREASE EJECTION FORCE

(75) Inventor: Hiroto Sugahara, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/359,321

(22) Filed: Jul. 23, 1999

(30) Foreign Application Priority Data

Jul. 24, 1998 (JP) ..... 10-209008

(51) Int. Cl.[7] ..... B41J 29/38; B41J 29/393

(52) U.S. Cl. ..... 347/10; 347/11; 347/14; 347/19

(58) Field of Search ..... 347/10, 11, 14, 347/19

(56) References Cited

U.S. PATENT DOCUMENTS 5,475,405 * 12/1995 Widder et al. ..... 347/14
5,557,304 * 9/1996 Stortz ..... 347/15
5,764,256 * 6/1998 Zhang ..... 347/71
5,790,139 * 8/1998 Umeno et al. ..... 347/10
6,000,773 * 12/1999 Murray et al. ..... 347/7
6,116,717 * 8/2000 Anderson et al. ..... 347/19

* cited by examiner

*Primary Examiner*—Huan Tran
*Assistant Examiner*—Alfred Dudding
(74) *Attorney, Agent, or Firm*—Oliff & Berridge, PLC

(57) ABSTRACT

A print head ejects ink from ink channels by deformation of piezoelectric material. The number of times ink is ejected by the head is calculated and stored in the memory provided integrally with the print head. When the number of drive times is determined to exceed a predetermined number, then after a print medium is changed, for example, because of a new page, then the pulse width or the pulse height of the waveform of the drive pulse applied to the piezoelectric is changed. Accordingly, reduction in deformation amount caused by degradation of polarization of the piezoelectric can be compensated for, so that speed and volume of ejected ink droplet can be recovered.

27 Claims, 9 Drawing Sheets

INK JET PRINTER THAT CHANGES WAVEFORM OF DRIVE PULSE TO INCREASE EJECTION FORCE

BACKGROUND OF THE INVENTION

1. Field of the Invention

The present invention relates to an ink jet printer for ejecting ink to print images, such as characters and symbols.

2. Description of the Related Art

Ink jet printers can be divided roughly into two types depending on how they generate force for ejecting ink droplets. Electrothermal conversion types generate force by converting electric power into heat, and electromechanical conversion types generate force by converting electric power into mechanical force.

Electrothermal conversion types use a thermal resistor or other actuator to heat a portion of ink filling an ink chamber to boiling. The force of the resultant expanding vapor bubble ejects an ink droplet through a nozzle of the ink chamber.

Electromechanical conversion types use electric power to mechanically deform piezoelectric material in order to eject ink. That is, a voltage is applied either perpendicular to or parallel with the polarization direction of the piezoelectric material. As a result, the piezoelectric material deforms so as to apply pressure to ink in an ink channel. An ink droplet is ejected from a nozzle of the ink channel as a result.

Electromechanical converting type ink jet printers can be divided into two types. In the first type, a side of an ejection channel is covered by a vibration plate, or a diaphragm. A piezoelectric material is disposed on top of the vibration plate. In the second type, a plurality of ejection channels are cut directly into a plate of piezoelectric material. The ejection channels are partitioned by side walls formed from the piezoelectric material.

SUMMARY OF THE INVENTION

In both electrothermal and electromechanical converting type ink jet printers, ejection characteristics degrade after the actuators are driven a great number of times. When the ejection characteristics degrade, speed and volume of ejected ink droplets decrease. Recording quality degrades, especially when the print head is mounted on a carriage that scans in front of the recording medium. In this case, the position where droplets impinge on the recording medium can become shifted out of alignment with surrounding dots.

Recording quality degrades to a particularly high degree with piezoelectric ink jet printers, because the polarization of the piezoelectric can greatly degrade when the piezoelectric material is driven a great number of times. As the polarization of the piezoelectric material degrades, the piezoelectric material will deform less and less when applied with the same voltage. The problem of shift in dot location occurs as a result.

It is an objective of the present invention to overcome the above-described problems and to provide an ink jet printer that compensates for reduction in speed and volume of ejected ink droplets caused by the print head being driven a large number of times, so that good print quality can be maintained over a long period of time.

According to a first aspect of the present invention, an ink jet printer includes a counter that counts the number of times a drive circuit drives a print head. A memory stores the number of times counted by the counter. Based on the number of times stored in the memory, a waveform change unit changes waveform of the drive pulse applied by the drive circuit to the print head, in order to increase force at which the print head ejects ink. With this configuration, the waveform of the drive pulse can be changed based on the number of times the print head is driven, to take into account degradation of printing characteristics that occur when the print head is driven a large number of times.

The ink jet printer is desirably a piezoelectric type ink jet printer, wherein the print head includes an actuator formed from piezoelectric material. Force to eject ink from an ejection channel is generated by the drive circuit applying drive pulses to the piezoelectric material, so that the piezoelectric material deforms. In this case, even if the polarity of the piezoelectric material degrades after the piezoelectric material is driven for a great number of times, print quality can be maintained in a good condition by changing the waveform of the drive pulse based on the number of times the drive circuit drives the print head.

It is desirable that the piezoelectric type print head and the memory both be mounted on a head holder, which is detachably mounted on the carriage of the printer. With this configuration, both the print head and the memory are exchanged together with the head holder. In other words, when the print head is exchanged for a new one, the memory will be exchanged as well. As a result, the number of drive pulses applied to the new print head will be counted starting from zero. Also, print heads can be temporarily switched, for example, to change printing colors, without confusing the number of drive times for different print heads.

It is also desirable that the piezoelectric actuator include partition walls that define the ejection channels, and that the partition walls be at least partially polarized. With this configuration, the change in the waveform of the drive pulse is immediately reflected in ejection of ink.

According to a second aspect of the present invention the memory is connected to the print head, and the print head is detachably mounted on the printer body. The printer body includes a control circuit that includes the counter, and that updates the number of times in the memory each time a certain amount of printing is completed. With this configuration, the memory is replaced along with the print head, so that calculation of the number of drive times is started afresh with respect to the newly replaced print head. Also, because the number of drive times is counted on the printer body side and the counted number is stored in the memory on the print head, counting operations are easy to control and there is no need to frequently store the numbers in the memory.

According to a third aspect of the present invention, a print medium judgement unit is provided to judge timing of when printing is stopped on one print medium before starting on another print medium. A waveform change unit changes the waveform of the drive pulse only at timing judged by the print medium judgement unit.

If the waveform of the drive pulse is changed while printing on a particular recording medium, then the location where the change is made will be obvious to the user, because, for example, the portion of an image printed before changing the waveform may have a lighter tone than the portion printed after changing the waveform. However, when this change is made between separate recording media as per this aspect of the present invention, that is after printing on one printing medium has stopped but before printing on another printing medium has started, then the change will not be so obvious so that printing quality can be maintained at a high level.

It is desirable that the waveform be changed at timing based on either a new page signal or a new print command, but most desirably based on a new page signal, because the change can be made more quickly.

It is desirable that the waveform change unit control the drive circuit to change the width or height of the waveform of drive pulses applied to the print head. With this configuration, although printing characteristics of the print head will degrade when the print head is driven a great number of times, this degradation can be compensated for so a predetermined ejection speed and an ejection volume can be maintained. Ejection can be performed efficiently.

BRIEF DESCRIPTION OF THE DRAWINGS

The above and other objects, features and advantages of the invention will become more apparent from reading the following description of the preferred embodiment taken in connection with the accompanying drawings in which:

FIG. 11(*b*) is a schematic view showing a drive pulse resulting from changing pulse width of the drive pulse shown in FIG. 11(*a*);

FIG. 11(*c*) is a schematic view showing a drive pulse resulting from changing pulse height (voltage) of the drive pulse shown in FIG. 11(*b*);

FIG. 12(*b*) is a schematic view showing a drive pulse resulting from changing pulse height (voltage) of the drive pulse shown In FIG. 12(*a*);

FIG. 13(*b*) is a schematic view showing a preliminary pulse with a width (time duration) that is lower than that of an ejection pulse.

DETAILED DESCRIPTION OF THE PREFERRED EMBODIMENT

Figure 1:
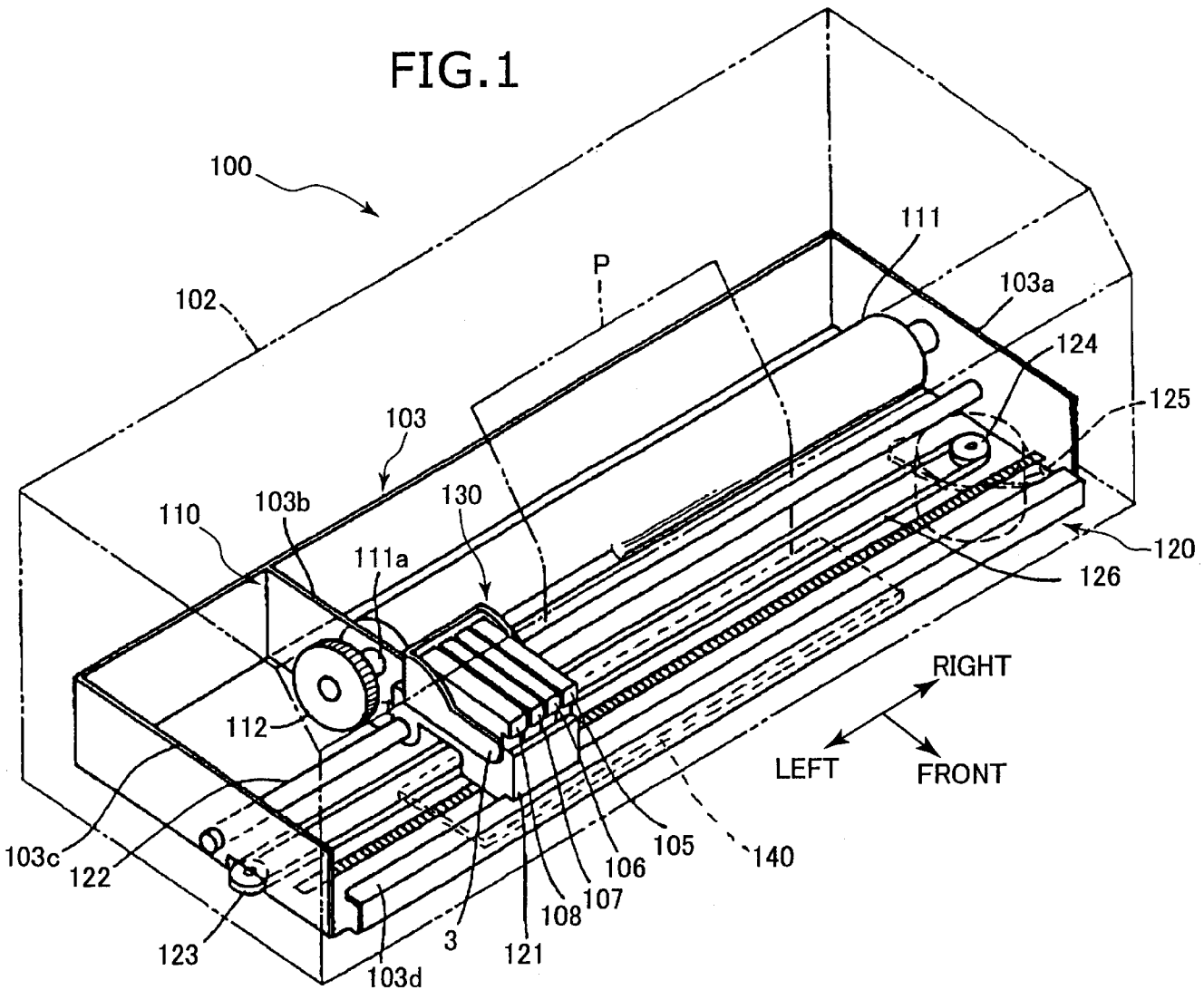
FIG. 1 is a perspective view partially in phantom showing a color ink jet-type printer according to a preferred embodiment of the present invention.

A color ink jet-type printer 100 according to a preferred embodiment of the present invention will be described while referring to the accompanying drawings wherein like parts and components are designated by the same reference numerals to avoid duplicating description. Words such as up, down, left, and right, for describing direction, will be used to describe configuration of the printer assuming the printer is in the orientation in which it is intended to be used.

As shown in FIG. 1, the Jet-type printer device 1 includes a cover 102, a frame 103, a paper feeding mechanism 110, a carriage driving mechanism 120, an ink jetting mechanism 130, and a circuitry board 140.

The paper feeding mechanism 110 includes a rubber platen 111 for supporting and transporting a print sheet P. The platen 111 has a platen shaft 111*a* rotatably supported at both axial ends by side wall plates 103*a* and 103*b* of the frame 103, and is arranged to extend laterally (i.e., in parallel with left and right directions as shown in FIG. 1). A platen gear 112 is attached to the left axial end of the platen shaft 111*a* and is connected to a paper feeding motor (not shown) through a gear mechanism (not shown). The platen 111 is rotated in a paper feeding direction by rotational force of the paper feeding motor, as transmitted by the gear mechanism.

The carriage driving mechanism 120 is for driving a carriage 121 to move. The carriage 121 is slidably supported on a guide rail 103*d* of the frame 103 and a guide rod 122 fixed to the side wall plates 103*a* and 103*c* of the frame 103. This configuration enables the carriage 121 to freely slide horizontally in front of and in parallel with the platen 111. The carriage 121 is fixed to a section of an endless timing belt 126, which is mounted on a driving pulley 124 and a driven pulley 123. The driving pulley 124 is attached to the shaft of a carriage driving motor 125, and is disposed at the rightmost position of the moving range of the carriage 121. The driven pulley 123 is rotatably supported by the side wall plate 103*c* at the leftmost position of the movable range of the carriage 121. The driven pulley 123 is operatively coupled to the driving pulley 103 through the endless timing belt 126. With this configuration, rotational force of the carriage driving motor 125 is transmitted to the carriage 121 via the pulleys 123, 124 and the timing belt 126, so that the carriage 121 is reciprocally moved in parallel with the paper P supported on the platen 111, while guided by the guide rod 122 and the guide rail 103*d*.

The ink jetting mechanism 130 is for printing colored images on the paper P in association with movement of the carriage 121 and the paper P. The ink jetting mechanism 130 includes a head holder 3 and ink cartridges 105 through 108. The head holder 3 is detachably mounted on the carriage 121. The ink cartridges 105 through 108 are detachably mounted in the head holder 3. Each ink cartridge 105 through 108 stores one of four color inks (cyan, magenta, yellow, and black) therein.

The frame 103, the cover body 102, and other components that are fixed with respect to the frame 103 and the cover body 102, will be referred to collectively as the printer body hereinafter. Therefore, according to the present embodiment, the circuitry board 140 and the carriage 121 are attached to the printer body, and the head holder 3, and consequently a memory 10 to be described later, is detachably mounted on the printer body.

Figure 2:
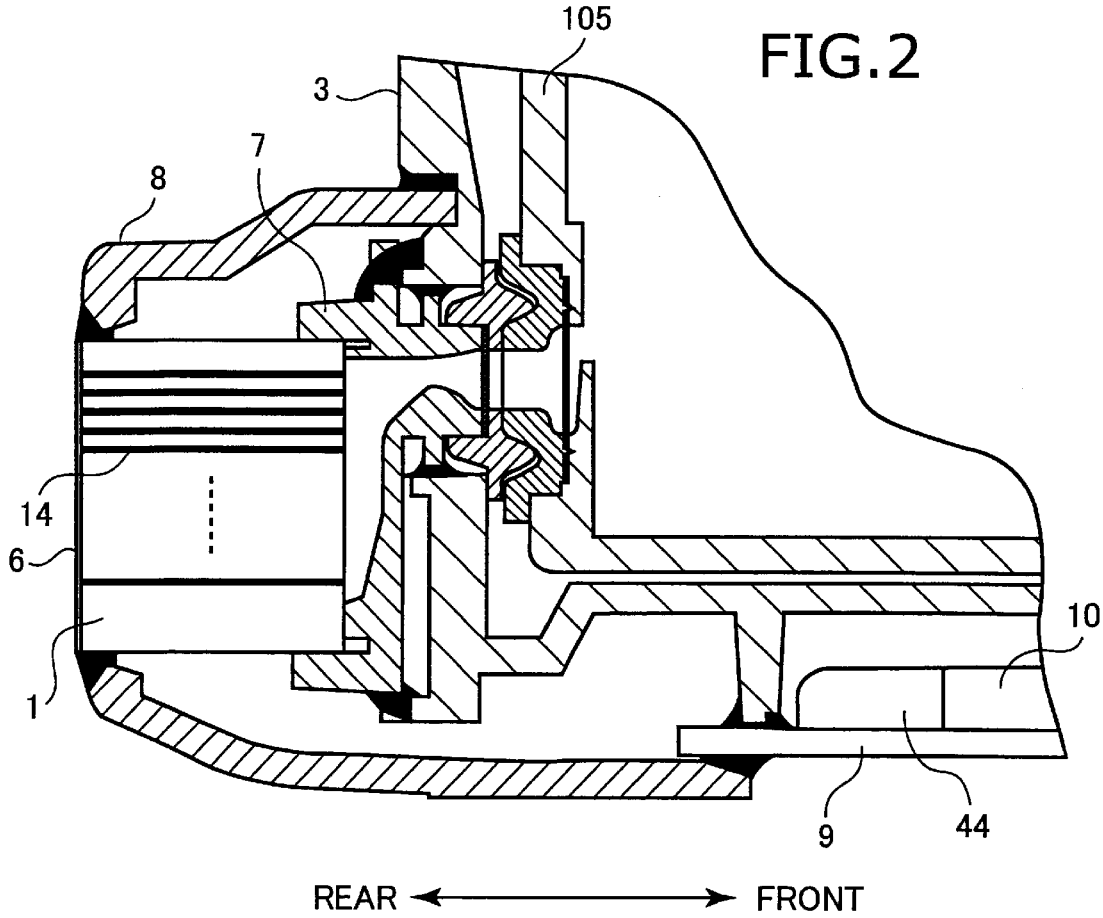
FIG. 2 is a cross-sectional view showing a portion of a head holder, including a print head, according to the present invention.

FIG. 2 shows components in the vicinity of the head holder 3, including the ink cartridge 105. Each of the ink cartridges 105 to 108 have substantially the same configuration, so further explanation will be provided for the ink cartridge 105 alone as a representative example.

Figure 6:
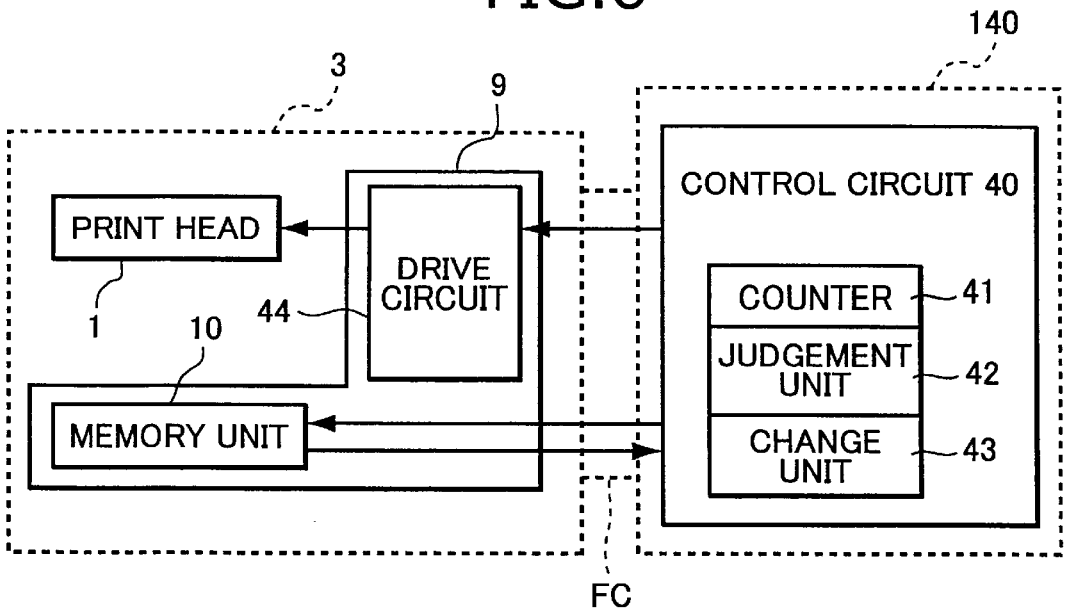
FIG. 6 is a block diagram showing configuration of a control system of the ink jet printer according to the present embodiment.

A print head 1, which corresponds to the ink cartridge 105, is fixed to the head holder 3. Although not shown in the drawings, a separate print head is provided for each ink cartridge. A cover 8 covers the printer head 1. A manifold 7 connects the ink cartridge 105 to ejection channels 14 formed in the print head 1, so that ink from the ink cartridge 105 can be supplied to the ejection channels 14 through the manifold 7. A printed wiring board 9 is mounted on the head holder 3. A non-volatile memory 10, such as an EEPROM, and a drive circuit 44 are fixedly mounted on the board 9. Consequently, the print head 1, the memory 10, and the drive circuit 44 are integrally attached to each other and to the head holder 3. The memory 10 separately stores the number of times each ejection channel 14 of the print head 1 has been driven. The drive circuit 44 is connected to print head 1 by wiring W as shown in FIG. 6.

Figure 4:
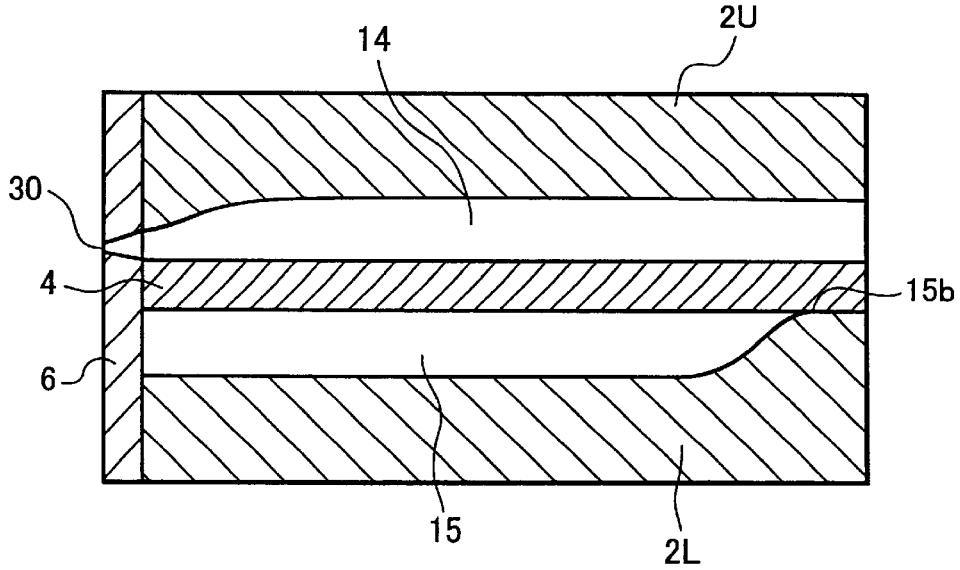
FIG. 4 is a cross-sectional view showing the print head of FIG. 3 in an assembled condition, as viewed from the right side of FIG. 3.
Figure 3:
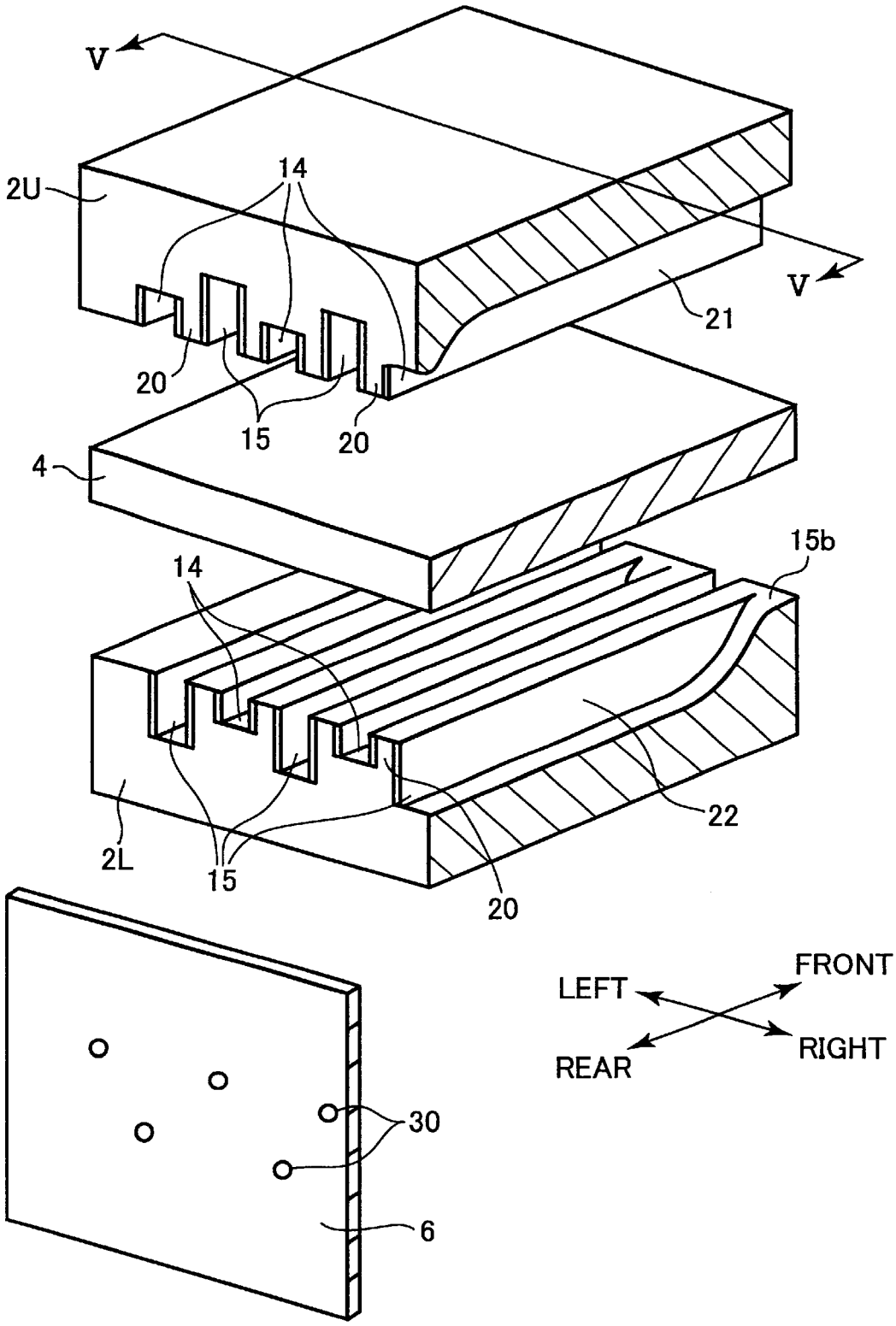
FIG. 3 is an exploded perspective view, in cross section, showing the print head.
Figure 5:
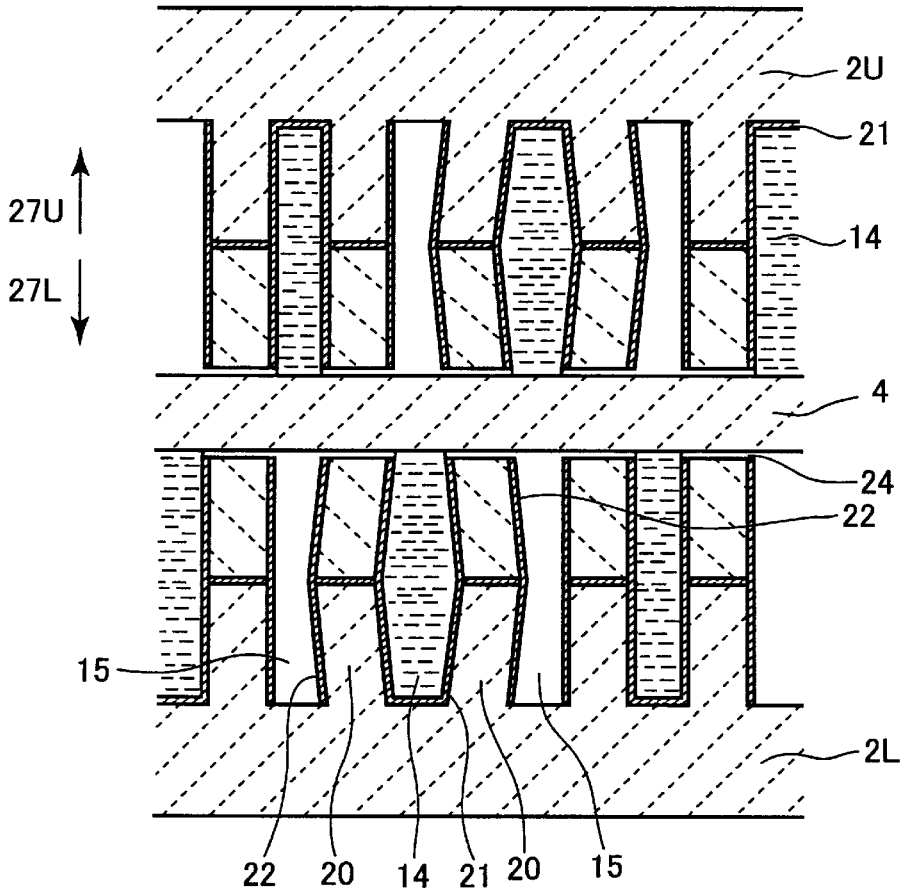
FIG. 5 is a cross-sectional view showing the print head of FIG. 3 in an assembled condition, taken along line V—V of FIG. 3.

FIGS. 3 through 5 show configuration of the print head 1. The print head 1 according to the present embodiment includes actuator substrates 2U, 2L, a plate member 4, and a nozzle plate 6. The plate member 4 is interposed between the actuator substrates 2U, 2L. The nozzle plate 6 is adhered onto front surfaces of the plate member 4 and the actuator substrates 2U, 2L.

As shown in FIG. 5, the actuator substrate 2U is formed from two layers of piezoelectric material, both of which are polarized in the thickness direction of the actuator substrate 2U, but in opposite directions as indicated by hatching and arrows 27U, 27L in FIG. 5. Similarly, the actuator substrate 2L is formed from two layers of piezoelectric material polarized in opposite directions from each other as indicated by hatching in FIG. 5.

As best seen in FIGS. 3 and 4, a plurality of grooves forming ejection channels 14 and dummy channels 15 are cut into the confronting surfaces of the actuator substrates 2U, 2L, so as to extend in parallel with each other from a rear end of the actuator substrates 2U, 2L to the front end of the actuator substrates 2U, 2L. With this configuration, the ejection channels 14 and the dummy channels 15 are separated by partitioning walls 20 formed from two piezoelectric material layers that are polarized in opposite directions as described above.

The ejection channels 14 are for ejecting ink and are provided in alternation with the dummy channels 15. The ejection channels 14 are cut to a predetermined depth from the front to rear end of the actuator substrates 2U, 2L, which the exception of a portion near the rear end, near the nozzle plate. The dummy channels 15 are formed to a predetermined depth, except for an upward slope upward near an end portion 15*b*, which is sealed off. Because the end portion 15*b* of each dummy channel 15 is sealed off, ink from the cartridge is distributed through the manifold 7 only to the ejection channels 14.

The plate member 4 is fixed by adhesive 24 between the actuator substrates 2U, 2L. The plate member 4 covers the confronting surfaces of the actuator substrates 2U, 2L, which are formed with the channels 14 and 15, and follows the lengthwise direction of the channels 14, 15.

The nozzle plate 6 is fixed to the front ends of the actuator substrates 2U, 2L and the front end of the plate member 4. Nozzle holes 30 are formed in the nozzle plate 6 at positions corresponding to the ejection channels 14. The print head 1 ejects ink from the ink cartridge 5 through the nozzle holes 30.

As shown in FIG. 5, an interior electrode 21 is formed on each inward-facing side surface of the partitioning walls 20, that is, on each side surface that face into an ejection channel 14. In the present embodiment, the interior electrodes 21 are connected to ground. Left and right independent electrodes 22, 22 are also formed on the partitioning walls 20, but on side surfaces that face into the dummy channels 15. When a drive pulse from the drive circuit 44 is applied to the electrodes 22, 22 on the partitioning walls 20, 20, then an electric field is developed in both partitioning walls 20, 20 in a direction perpendicular to the direction in which the actuator substrates 2U, 2L are polarized. As a result, the partitioning walls 20, 20 deform into a chevron shape, that is, when viewed in cross section as shown in the lower half of FIG. 5. After a predetermined time duration elapses from when application of the drive pulse is first started, application of the drive pulse to the electrodes 22, 22 is stopped so that the partitioning walls 20, 20 return to their initial shape of before deformation. As a result, ink In the ejection channels 14 is ejected from the corresponding nozzle 30. In this way, the partitioning walls 20, 20 that define an ejection channel 14 serve as an actuator for the ejection channel 14.

Ink can be efficiently ejected from the ejection channels 14 when the predetermined time duration, that is, from start to stop of application of the drive pulse, equals an odd multiple of a time duration T. In other words, the pulse width of the drive pulse is set to a value determined by multiplying the time duration T by an odd integer. The time duration T is the time required for the pressure wave vibration to propagate once through the ejection channels 14, and is calculated by the following equation:

$$T=L/C$$

wherein L is the length of the ejection channel; and

C is the speed of sound in the ink filling the ejection channel.

The reason for this timing is that after the time duration T elapses an odd number of times, the negative pressure in the ink that was induced by expansion of the space between the partitioning walls 20, 20 inverts to a positive pressure. When application of the drive pulse is stopped at this time, the partitioning walls 20, 20 revert to their initial shape of before being deformed by application of the drive pulse, so that pressure is applied to the ink in the ejection channels 14, which has a positive pressure due to the above-described pressure inversion. Ink is efficiently ejected from the ejection channels 14 by combination of these two types of positive pressure.

As shown in FIG. 6, a control circuit 40 is fixed on the circuitry board 140 of the printer body. The control circuit 40 is connected to the drive circuit 44 and the memory 10 of the printed wiring board 9, which is provided integrally on the head holder 3 as mentioned previously, by wiring of a flexible cable FC and by contact points (not shown) on the carriage 121. The drive circuit 44 is for supplying drive pulses to the print head 1.

The control circuit 40 is for controlling the ink jet printer. The control circuit 40 includes a counter 41, a judgement unit 42, and a change unit 43. The control circuit 40 receives print data from an external source, such as a personal computer, and outputs the print data to the drive circuit 44 as serial data. The drive circuit 44 converts the serial data into parallel data for each of the ejection channels 14 of the print head 1, and then outputs drive pulses to corresponding ejection channels 14 accordingly. It will be understood that at this time, the drive pulses are actually outputted to the electrodes of the actuators of ejection channels 14.

Figure 7:
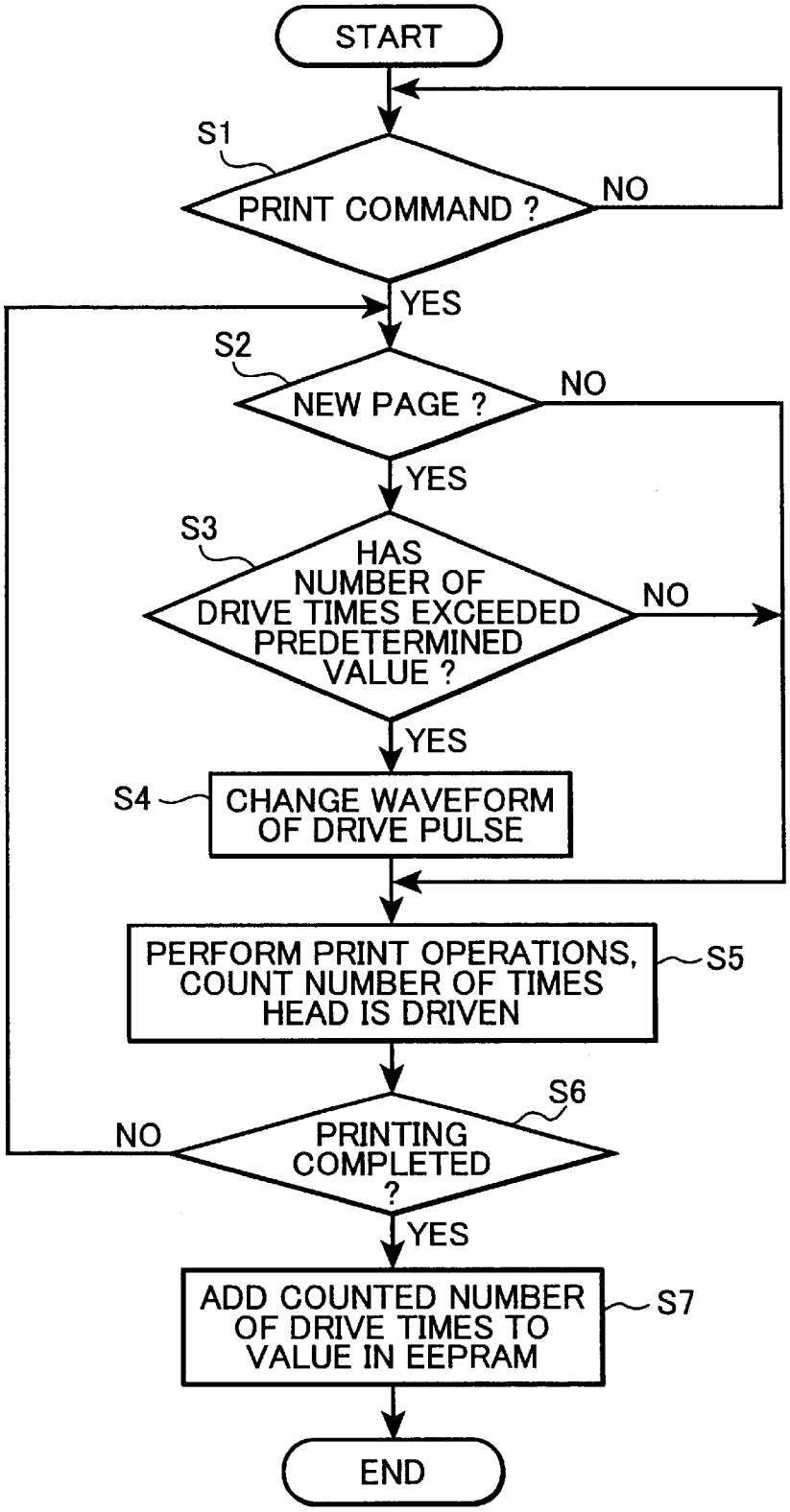
FIG. 7 is a flowchart showing control processes performed by the control system shown in FIG. 6.
Figure 8:
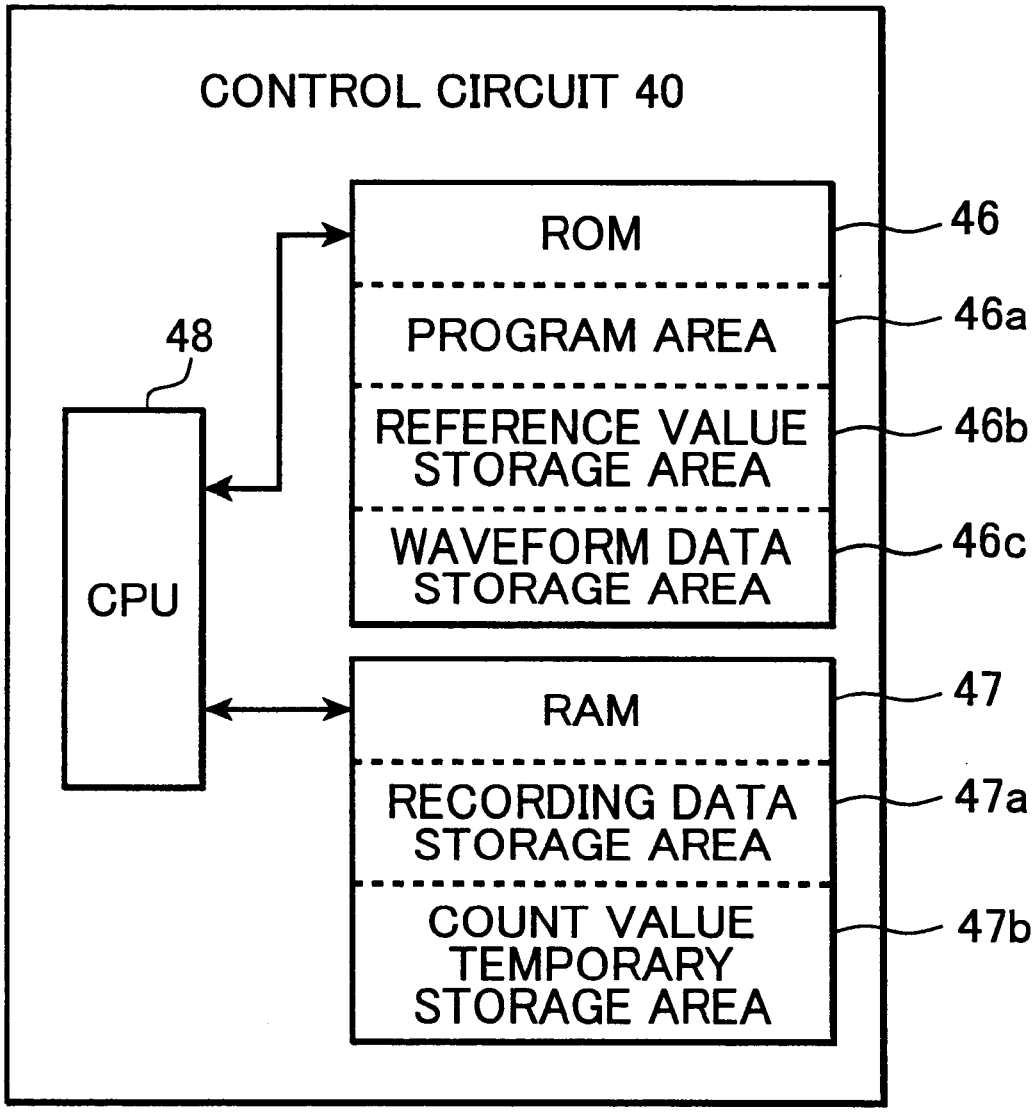
FIG. 8 is a block diagram showing an exemplary configuration of the control system shown in FIG. 6.

FIG. 7 is a flow chart representing control process preformed by the control circuit 40 to determine timing of when the waveform of drive pulses for driving the print head 1 is to be changed. As mentioned previously, the memory 10 stores the number of times each ejection channel 14 of the print head 1 has been driven up to now. When power of the printer is turned on, or when a print command is received, the control circuit 40 retrieves the of drive time numbers stored in the memory 10, and stores the numbers in the counter 41. When a print command is received (S1:YES), whether or not a page return signal has been received is determined in S2. If not (S2:NO), then in S5, printing is performed according to print data outputted to the print head 1. During S5, the counter 41 counts the number of times the drive circuit 44 drives the print head 1. More precisely, the control circuit 40 controls the counter 41 to count the amount of data outputted to the print head 1 during this printing operation, in order to count the number of times the drive circuit 44 drives each ejection channel 14 of the print head 1 during the present printing operation. The control circuit 40 controls the counter 41 to add the counted numbers to the values retrieved from the memory 10.

When a return page signal is received (S2:YES), then in S3, the judgement unit 42 of the control circuit 40 determines whether or not the number of times any of the ejection channels 14 have been driven exceeds a predetermined number of drive times. If not (S3:NO), then the routine proceeds to the printing operations of S5. If any of the ejection channels 14 has been driven more than the predetermined number of times (S3:YES), then in S4, the change unit 43 of the control circuit 40 changes the waveform of the drive force outputted to the drive circuit 44. The drive pulse outputted from the drive circuit 44 to the print head 1 will change accordingly. Next in S5, printing is performed using the drive pulse with the new waveform.

When printing has been completed for all print data, for example, for a single print job, that was received over a predetermine period of time, or for some other certain amount of printing (S6:YES), then in S7, the total number of times each ejection channel 14 of the print head 1 has been driven up to now, as counted by the counter 41, is stored in the memory 10, thereby updating the count number stored in the memory 10 for each ejection channel 14.

An exemplary configuration of the control circuit 40 will be described next with reference to FIG. 6. In this example, the control circuit 40 includes a CPU 48, a ROM 46, and a RAM 47. The CPU 48 is connected to the ROM 46 and the RAM 47 by bus lines. The ROM 46 includes a program area 46*a* and a reference value storage area 46*b*. The RAM 47 has a recording data storage area 47*a* and a count value temporary storage value 47*b*.

The functions of the counter 41, the judgement unit 42, and the change unit 43 shown in FIG. 6 can be performed by the CPUT 48, the ROM 46, and the RAM 47 in the following manner. It should be noted that the following explanation is an example only. The functions of the counter 41, the judgement unit 42, and the change unit 43 shown in FIG. 6 can be performed by a variety of other means.

The program storage area 46*a* of the ROM 46 stores a program for controlling overall operation of the ink jet printer. For example, the CPU 48 controls the print head 1, the carriage driving mechanism 120, and the paper feeding mechanism 10 based on this program. The recording data storage region 47*a* of the RAM 47 stores recording data received from an external source, such as a personal computer. The CPU 48 retrieves the recording data from the recording data storage region 47*a* and sends it to the drive circuit 44 as serial data. The drive circuit 44 converts the serial data into parallel data for each ejection channel 14 of the print head 1, and outputs the parallel data as drive pulses to the ejection channels 14.

When the power source is turned on or a print command data is received, the CPU 48 retrieves the drive numbers stored separately in the memory 10 for all of the ejection channels 14, and stores them in the counter number temporary storage area 47*a*. When print command data is received (S1:YES) and when no page return is present (S2:NO), then in S5 the print data is outputted to the print head 1 and printing processes are executed accordingly. At this time, the CPU 48 adds the amount of print data outputted for the ejection channels 14 to the drive numbers stored in the counter number temporary storage area 47*a*. That is, the CPU 48 adds the number of times each ejection channel 14 is operated, to the drive number that is stored in the counter number temporary storage area 47*a* for the corresponding ejection channel 14. In this way, the number of drive times is counted for each ejection channel 14.

When a page return signal is received (S2:YES), the CPU 48 determines whether or not the number of times any of the ejection channels has been driven has exceeded a predetermined number of drive times. That is, the CPU 48 compares each count number stored in the counter number temporary storage area 47*a* with a reference value prestored in the determination reference value storage region 42*a*. If none of the count numbers exceeds the reference value (S3:NO), then printing operations are continued in S5. Once any of the drive count numbers exceeds the reference value (S3:YES), then in S4 the CPU 48 retrieves waveform data stored in the waveform data storage area 43*c* of the ROM and changes the drive waveform outputted to the drive circuit 44 according to the retrieved waveform data. As a result, the drive waveform outputted from the drive circuit 44 to the print head 1 also changes.

From that point on, printing in S5 is performed based on the new drive waveform to eject ink with greater force. It should be noted that when it is determined that one of the ejection channels 14 has been driven by more than the predetermined reference number, then the drive pulse waveform can be changed either for all ejection channels or for only those ejection channels that have been driven by more than the predetermined reference number. That is, when it is determined that one of the ejection channels 14 is driven by more than the predetermined number of times, then the waveform of drive pulses applied only to that ejection channel can be changed or the waveform of drive pulses applied to all ejection channels can be changed.

When printing operations based on the received print data have been completed (S6:YES), then the CPU 48 retrieves the count numbers, that is, the drive numbers, from the count value temporary storage area 41*a*, and stores them in the memory 10.

Figure 9:
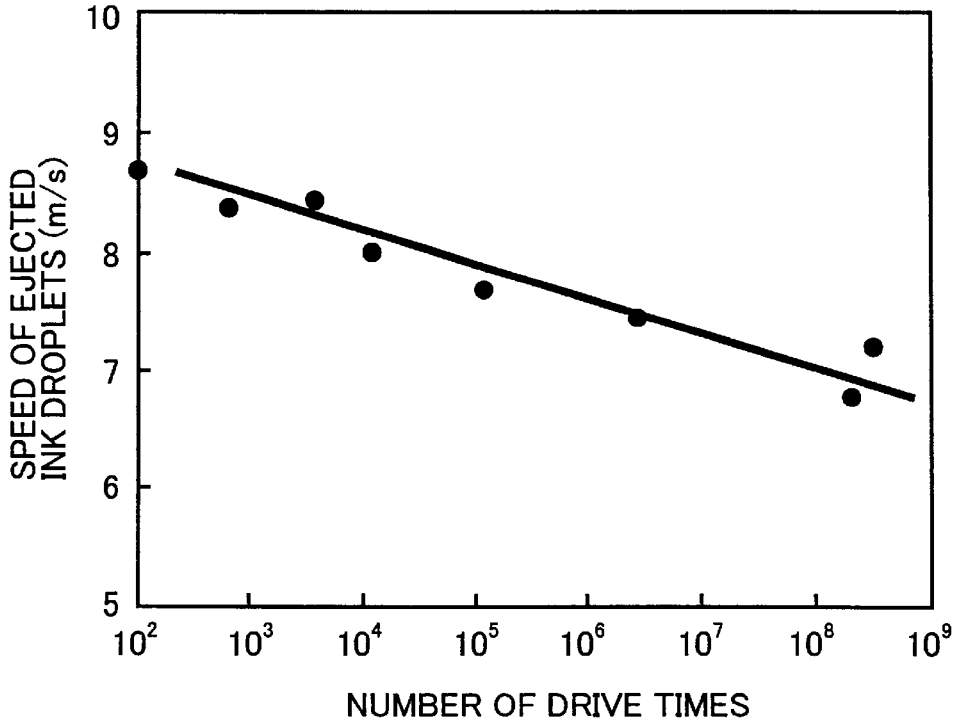
FIG. 9 is a graph showing the relationship between the ejection speed of ink droplets and the number of drive times of the head.

As mentioned previously, the polarization of the piezoelectric material that forms an actuator, degrades in association with the number of times the actuator is driven. When the polarization degrades, the amount that the partitioning walls 20, 20 deform decreases, so that the speed of ejected droplets also decreases. When the number of drive times is expressed logarithmic form as shown in FIG. 9, reduction in ejection speed has a substantially linear relationship with the number of times any particular ejection channel is driven. As the ejection speed drops, the position where ink droplets impinge on a recording medium shifts. Recording quality suffers as a result.

Figure 10:
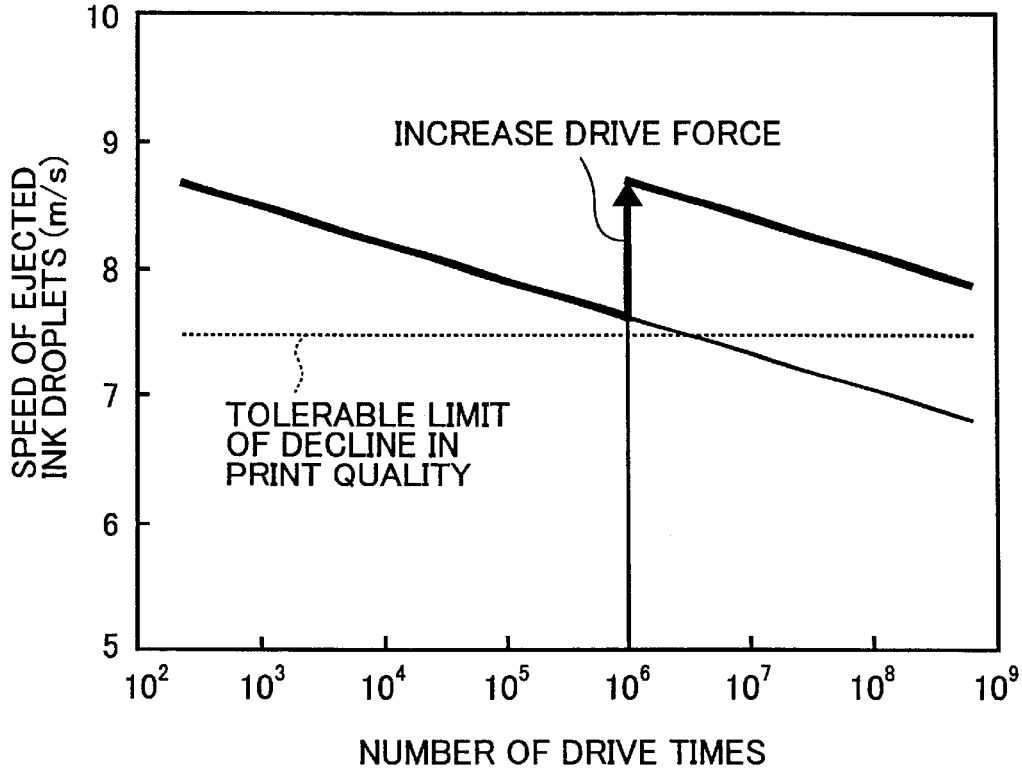
FIG. 10 is a graph showing the effect of changing waveform of the drive pulse on ejection speed.

Here, an example will be provided for determining the reference value stored in the reference value storage area 46*b*. In this example, it will be assumed that print quality is unacceptable when the ejection speed drops below 7.5 m/s, although this is not a particular limitation of the present invention. The waveform of the drive pulse is changed to increase the drive energy to recover the ejection speed before the ejection speed drops below 7.5 m/s. Using the graph in FIG. 9, it can be determined that the ejection speed for an actuator drops below 7.5 m/s when the actuator has been driven $10^6$ times. Therefore, the reference value stored in the reference value storage area 46*b* is set to about $10^6$ times. As a result, as shown in FIG. 10 the waveform of the drive pulse is changed to increase the drive energy when the actuator of any ejection channel 41 has been driven about $10^6$ times.

The waveform can be changed in a variety of ways to increase ejection speed. For example. the width of the waveform can be changed from that shown in FIG. 11(*a*) to that shown in FIG. 11(*b*). As described previously, ejection is most efficient when the width of the drive pulse is equivalent to an odd multiple of the time required for the pressure wave to propagate once within the ejection channel (i.e., n×L/C, wherein n is an odd integer). Therefore, at the start of printing, the width of the drive pulse is intentionally set to a width that is not an odd multiple of the time required for a pressure wave to propagate once through an ejection channel, so that energy efficiency is slightly low. That is, the waveform shown in FIG. 11(*a*) is used, because its pulse width is 1.3 times L/C, and not odd multiple of L/C, and so results in slightly low energy efficiency. Once the number of times a drive pulse is applied to the side walls of any ejection channel exceeds the predetermined reference value, the waveform of the drive pulse is changed to a width that is nearer an odd multiple of the time required for a pressure wave to propagate once through an ejection channel. That is, the waveform of the drive pulse is changed to that shown in FIG. 11(*b*), because the pulse width is an odd multiple of (one times) L/C, so energy efficiency increases.

Figure 12A:
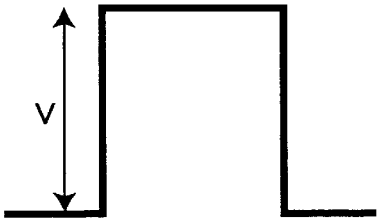
FIG. 12(*a*) is a schematic view showing a drive pulse applied to an actuator of the print head to eject ink droplets.
Figure 12B:
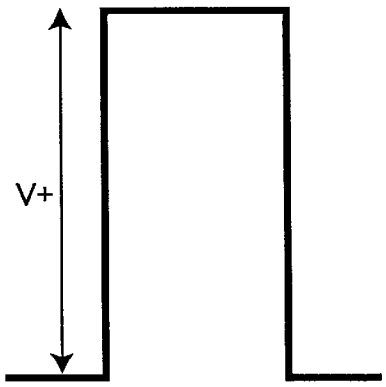

Alternatively, the height of the pulse, that is, the voltage of the drive pulse, can be increased from a voltage V shown in FIG. 12(*a*) to a higher voltage V+ as shown in FIG. 12(*b*).

Figure 13A:
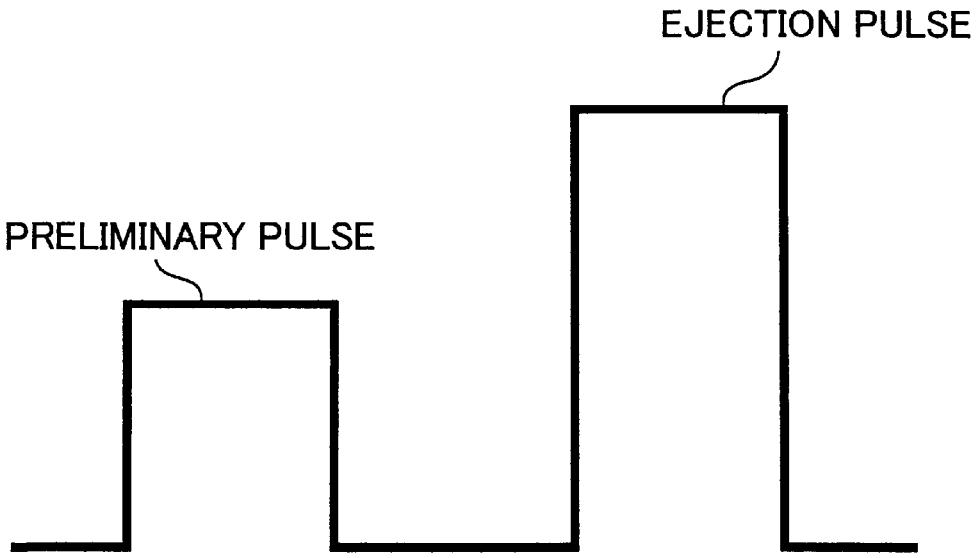
FIG. 13(*a*) is a schematic view showing a preliminary pulse with a height (voltage value) that is lower than that of an ejection pulse.
Figure 13B:
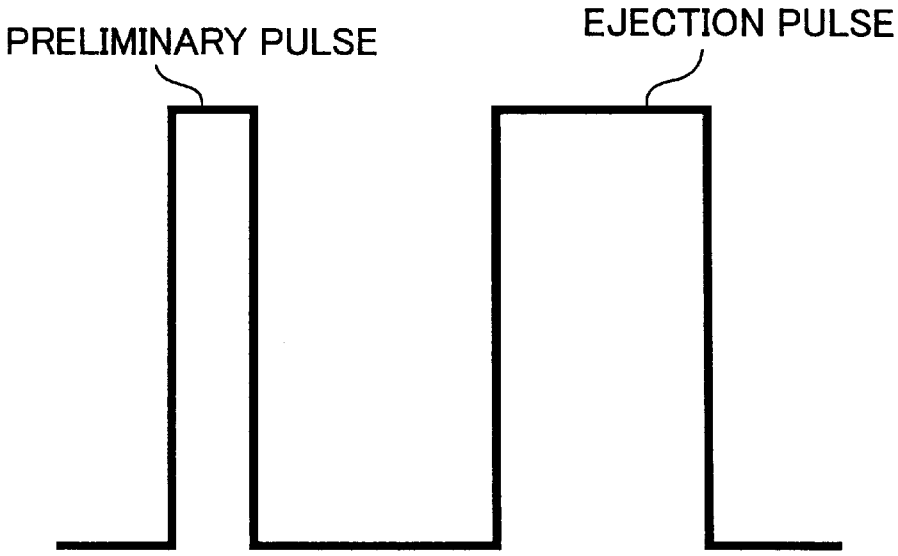

The waveform of the drive pulse can be changed by adding a preliminary pulse before the actual drive pulse. A preliminary pulse applies pressure to the ink in the ejection channels, but does not in itself contain sufficient energy to eject ink. Instead the preliminary pulse and the drive pulse are applied at a timing to synchronize the pressure wave fluctuation generated by the preliminary pulse with the pressure wave fluctuation generated by the subsequent drive pulse in order to change the ejection speed or volume of ejected ink droplets. The preliminary pulse can be used to increase or decrease the force of ink ejection, depending on the timing of the pulse. For example, a drive pulse by itself can be used for ink ejection until the predetermined number of ejections have been performed. Thereafter, a preliminary pulse is added before the drive pulse to increase force at which ink droplets are ejected. Examples of preliminary pulses are shown in FIGS. 13(*a*) and 13(*b*). The preliminary pulse in FIG. 13(*a*) has a height (voltage value) that is lower than that of the ejection pulse. The preliminary pulse in FIG. 13(*b*) has a width (time duration) that is shorter than that of the ejection pulse.

Figure 11A:
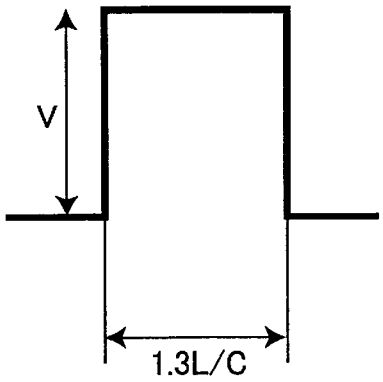
FIG. 11(*a*) is a schematic view showing a drive pulse applied to an actuator of the print head to eject ink droplets.
Figure 11B:
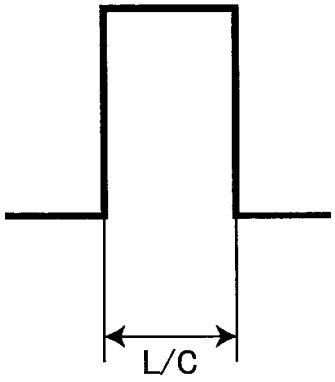
Figure 11C:
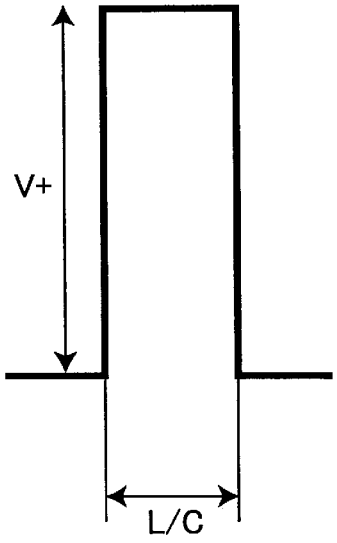

It should be noted that the ejection force of the ejection channels can be increased in a step-like manner based on a plurality of reference values. That is, when one of the ejection channels is driven for more times than a first reference value, the waveform is changed to increase ejection force. Subsequently it is determined whether or not one of the ejection channels is driven for more times than a second reference value. When the second reference value is exceeded, then the waveform is again changed to again increase ejection force. For example, the pulse width of waveform can be changed in the manner indicated in FIGS. 11(*a*) and 11(*b*) when the first reference value is exceeded, and by increasing the voltage as shown in FIG. 11(*c*) when the second reference value is exceeded. Further, when a final reference value is exceeded, then the printer can notify the user, using a display for example, that the life of the print head has been reached. It should be noted that the step-like increases can be achieved by using any combination of the control methods described above for changing the pulse width, increasing the pulse height, and adding a preliminary pulse.

Because the memory 10 is a non-volatile memory, such as an EEPROM, it will maintain the drive counts even if the head holder 3, which includes the print head 1, is detached from the carriage and remounted. Therefore, the total number of drive times for each ejection channel will not be altered for any particular head even in situations where the head holder 3 must be removed, such as during repairs or maintenance operations. Also, when the head holder 3 is replaced with a new head holder 3, the number of times the new print head 1 is driven will be counted starting from zero for each ejection channel, and stored in the memory 10 of the new head holder 3.

The control circuit 40 will only change the waveform if a new page signal has been received in S2 of FIG. 6, even if the number of drive times exceeds the reference value. As a result, the waveform will not be changed in the middle of printing any particular page. Therefore, the boundary between where images are recorded using one waveform and another waveform will not appear in the middle of a page, but instead will be in between pages and so will not stand out. The determination in S2 is not limited to determining whether a page return has been received. For example, when a print command for a new print job, that is, for printing out new print data, is received, it can be assumed that a different recording medium is set for printing out the new print data. In this case also, the boundary where the waveform changes will also not stand out. Therefore, in order to prevent the change boundary from appearing in the middle of a page, then whether a new job command has been received can be determined in S2 instead of, or in addition to, determining whether a page return command has been received.

While the invention has been described in detail with reference to specific embodiments thereof, it would be apparent to those skilled in the art that various changes and modifications may be made therein without departing from the spirit of the invention, the scope of which is defined by the attached claims.

For example, the embodiment described the side walls defining the ejection channels 14 as being formed from a piezoelectric material. However, the piezoelectric material can be attached to a vibration plate, and the same effects of the present invention can be achieved. The present invention can be applied to an electrothermal converting type ink jet printer.

What is claimed is:

1. An ink jet printer comprising;

a print head for ejecting ink, the print head being formed with an ejection channel filled with ink and including an actuator for generating force to eject ink from the ejection channel, the actuator being formed from piezoelectric material that deforms upon application of drive pulses;

a drive circuit that applies drive pulses to the actuator of the print head to drive the print head to eject ink from the ejection channel;

a counter that counts a number of times the drive circuit drives the print head;

a memory that stores, based on the number of times counted by the counter, a cumulative number of times that the drive circuit has driven the print head up to present; and a waveform change unit that, when the cumulative number of times stored in the memory exceeds a predetermined value, changes waveform of the drive pulse applied by the drive circuit to the print head, in order to increase force at which the print head ejects ink.

2. An ink jet printer as claimed in claim 1, further comprising:

a carriage that scans across a print medium; and a head holder detachably mounted on the carriage, the print head and the memory being mounted on the head holder.

3. An ink Jet printer as claimed in claim 1, wherein the actuator includes partition walls that define the ejection channels, the partition walls being at least partially polarized.

4. An ink jet printer as claimed in claim 1, wherein the waveform change unit changes the waveform by changing the width of the waveform to a width that is nearer an odd-number width, which is determined by multiplying an odd integer times a time duration required for a pressure wave generated in ink in the ejection channel to propagate once through the ejection channel.

5. An ink jet printer as claimed in claim 1, wherein the waveform change unit controls the drive circuit to change width of the waveform of drive pulses applied to the print head.

6. An ink jet printer as claimed in claim 1, wherein the waveform change unit controls the drive circuit to change height of the waveform of drive pulses applied to the print head.

7. An ink jet printer as claimed in claim 1, wherein the memory is connected to the print head, and further comprising a printer body adapted for detachably mounting the print head, the printer body including a control circuit that includes the counter, and that updates the number of times in the memory each time a certain amount of printing is completed.

8. An ink jet printer as claimed in claim 7, wherein the memory is a non-volatile memory.

9. An ink jet printer as claimed in claim 8, further comprising a temporary memory, wherein the control circuit:

retrieves the number of times from the non-volatile memory and stores the number of times in the temporary memory before a printing operation;

controls the counter to count a number of times the drive circuit drives the print head during the printing operation;

controls the counter to add the number of times counted during the printing operation to the number of times stored in the temporary memory; and updates the number of times in the non-volatile memory by storing the number of times in the temporary memory after the printing operation into the non-volatile memory.

10. An ink jet printer as claimed in claim 1, further comprising a print medium judgment unit that judges timing of when printing has been stopped on one print medium, but has not yet been started on another print medium, the waveform change unit changing the waveform of the drive pulse only at timing judged by the print medium judgment unit.

11. An ink jet printer as claimed in claim 10, wherein the print medium judgement unit judges the timing based on a page return signal.

12. An ink jet printer as claimed in claim 10, wherein the print medium judgement unit judges the timing based on a new print command.

13. An ink jet printer as claimed in claim 10, further comprising a sheet transport mechanism that successively feeds the separate print media to the print head.

14. An ink jet printer as claimed in claim 1, wherein the waveform change unit controls the drive circuit to change width of the waveform of drive pulses applied to the print head.

15. An ink jet printer as claimed in claim 1, wherein the waveform change unit controls the drive circuit to change height of the waveform of drive pulses applied to the print head.

16. An ink jet printer comprising:

a printer body;

a print head detachably mounted on the printer body, and for ejecting ink, the print head being formed with an ejection channel filled with ink and including an actuator for generating force to eject ink from the ejection channel, the actuator being formed from piezoelectric material that deforms upon application of drive pulses;

a drive circuit that applies drive pulses to the actuator of the print head to drive the print head to eject ink from the ejection channel;

a control circuit attached to the printer body, the control circuit including a counter that counts a number of times the drive circuit drives the print head;

a memory integrally connected to the print head, and that stores, based on the number of times counted by the counter, a cumulative number of times that the drive circuit has driven the print head up to present; and a waveform change unit that, when the cumulative number of times stored in the memory exceeds a predetermined value, changes waveform of the drive pulse applied by the drive circuit to the print head, in order to increase force at which the print head ejects ink, wherein the control circuit updates the number of times stored in the memory each time printing is completed.

17. An ink jet printer as claimed in claim 16, wherein the memory is a non-volatile memory.

18. An ink jet printer as claimed in claim 17, further comprising a temporary memory, wherein the control circuit:

retrieves the number of times from the non-volatile memory and stores the number of times in the temporary memory before a printing operation;

controls the counter to count a number of times the drive circuit drives the print head during the printing operation;

controls the counter to add the number of times counted during the printing operation to the number of times stored in the temporary memory; and updates the number of times in the non-volatile memory by storing the number of times in the temporary memory after the printing operation into the non-volatile memory.

19. An ink jet printer as claimed in claim 16, wherein the waveform change unit controls the drive circuit to change width of the waveform of drive pulses applied to the print head.

20. An ink jet printer as claimed in claim 16, wherein the waveform change unit controls the drive circuit to change height of the waveform of drive pulses applied to the print head.

21. An ink jet printer comprising:

a print head for ejecting ink to print images successively on a plurality of separate print media;

a drive circuit that applies drive pulses to the print head to drive the print head to eject ink;

a counter that counts a number of times the drive circuit drives the print head;

a memory that stores the number of times counted by the counter;

a print medium judgement unit that judges timing of when printing has been stopped on one print medium, but has not yet been started on another printing medium; and a waveform change unit that changes waveform of the drive pulse applied by the drive circuit to the print head in order to increase force at which the print head ejects ink, the waveform change unit changing the waveform based on the number of times stored in the memory and only at timing judged by the print medium judgement unit.

22. An ink jet printer as claimed in claim 21, wherein print medium judgement unit judges the timing based on a page return signal.

23. An ink jet printer as claimed in claim 21, wherein print medium judgement unit judges the timing based on a new print command.

24. An ink jet printer as claimed in claim 21, wherein the waveform change unit controls the drive circuit to change width of the waveform of drive pulses applied to the print head.

25. An ink jet printer as claimed in claim 21, wherein the waveform change unit controls the drive circuit to change height of the waveform of drive pulses applied to the print head.

26. An ink jet printer as claimed in claim 21, further comprising a sheet transport mechanism that successively feeds the separate print media to the print head.

27. An ink jet printer as claimed in claim 16, further comprising:

a print medium judgment unit that judges timing of when printing has been stopped on one print medium, but has not yet been started on another print medium, the waveform change unit changing the waveform of the drive pulse only at timing judged by the print medium judgment unit.

* * * * *